United States Patent [19]

Bauer et al.

[11] Patent Number: 4,592,119

[45] Date of Patent: Jun. 3, 1986

[54] AIR JET YARN ENTANGLING APPARATUS

[75] Inventors: Karl Bauer; Michael Hanisch, both of Remscheid, Fed. Rep. of Germany

[73] Assignee: Barmag Barmer Maschinenfabrik AG, Remscheid, Fed. Rep. of Germany

[21] Appl. No.: 676,723

[22] Filed: Nov. 30, 1984

[30] Foreign Application Priority Data

Feb. 18, 1984 [DE] Fed. Rep. of Germany ..... 3405891
Apr. 7, 1984 [DE] Fed. Rep. of Germany ..... 3413276

[51] Int. Cl.[4] ..... D02G 1/16; D02J 1/08

[52] U.S. Cl. ..... 28/271; 28/172; 28/185; 28/220; 28/241; 28/274

[58] Field of Search ..... 28/271, 272, 274, 172, 28/185, 220, 241; 57/333

[56] References Cited

U.S. PATENT DOCUMENTS

| | | | |
|---|---|---|---|
| 3,022,566 | 2/1962 | Daniels et al. | 28/271 X |
| 3,261,071 | 7/1966 | Clendening, Jr. et al. | 28/271 X |
| 3,324,526 | 6/1967 | Burns et al. | 28/271 |
| 3,448,498 | 6/1969 | Sando et al. | 26/3 |
| 3,659,350 | 5/1972 | McCullough | 28/274 X |
| 3,822,449 | 7/1974 | Dick | 28/272 |
| 4,011,640 | 3/1977 | Keith | 28/274 |

FOREIGN PATENT DOCUMENTS

| | | | |
|---|---|---|---|
| 59-43142 | 3/1984 | Japan | 28/271 |
| 1576355 | 10/1980 | United Kingdom . | |

*Primary Examiner*—Robert R. Mackey
*Attorney, Agent, or Firm*—Bell, Seltzer, Park & Gibson

[57] ABSTRACT

An apparatus is disclosed for simultaneously air jet entangling a plurality of advancing multifilament yarns. The apparatus comprises a plurality of elongate air jet beams, with each beam having a longitudinal air passageway extending along its length, and a plurality of parallel yarn ducts extending transversely through the beam. Also, an air jet aperture communicates between the air passageway and each yarn duct for directing an impinging airstream against an advancing yarn passing through the duct. The beams are mounted to a supporting frame, with the beams being horizontally disposed and vertically spaced apart, and the beams are each mounted for rotation about a horizontal axis which extends longitudinally along its length, and the supporting frame is itself mounted for rotational movement about a horizontal axis which is parallel to the rotational axes of the beams.

11 Claims, 8 Drawing Figures

AIR JET YARN ENTANGLING APPARATUS

The present invention relates to an apparatus for simultaneously air jet entangling a plurality of advancing multifilament yarns, and which is adapted for use in association with the drawing and warp beaming of such yarns.

When drawing multifilament yarns of thermoplastic materials, such as polyamides, polyester, polypropylene, and polyethylene, it is desirable that the yarns be subjected to air entanglement before or after the drawing operation. In such cases, an air jet is directed perpendicularly upon each running yarn. By reason of the geometric relocation of the individual filaments, the filaments receive a certain cohesion among themselves. As a result, this process has also been designated as interlacing, and is generally referred to by the description "entangling."

In the drawing of warp sheets of such multifilament yarns, in which for example a thousand or more yarns are withdrawn from a creel, guided to a common plane, and concurrently drawn between several rolls, there exists the problem of arranging an adequate number of air jet nozzles along the path of travel of the sheet.

German Auslegeschrift DE-AS No. 26 11 547 and corresponding British Pat. No. 1,576,355 disclose an apparatus for air entangling a warp sheet of yarns, and in which the air entanglement nozzles are sealably mounted to an air supply in a flat housing, which is connected to a source of air. A nozzle plate is arranged in a vertical plane, so that the air nozzles are directed essentially horizontally. As a result, the yarns which are supplied from all directions, are guided into the entanglement nozzles at different angles, and they leave the nozzles also at different angles. It has been found, however, that the guidance of the yarn past the nozzle substantially effects the quality of the yarn, and particularly the quality of the entanglement. It is, therefore, a disadvantage of the known air entanglement housing that a sheet of yarns of nonuniform quality results from the air entangling and drawing.

It is accordingly an object of the present invention to provide an air jet entangling apparatus for a warp sheet of yarns which is supplied from a plurality of horizontal and vertical planes, and which is able to create essentially uniform conditions for each yarn while passing through the entanglement nozzle.

This and other objects and advantages of the present invention are achieved in the embodiments illustrated herein by the provision of an apparatus which comprises a plurality of elongate air jet beams, with each beam having a longitudinal air passageway extending along its length, and a plurality of parallel yarn ducts extending transversely to the longitudinal direction of the beam and which are aligned in a longitudinally spaced-apart relation. Also, an air jet aperture communicates between the air passage and each yarn duct.

The beams are mounted to a supporting frame, with the beams being horizontally disposed and vertically spaced apart, and such that the beams are adjustably positioned with respect to each other and to the advancing yarns. The supporting frame of the apparatus preferably is of generally rectangular construction, and the means for mounting the beams to the frame includes means for pivotally mounting each beam to the support frame for rotational movement about a horizontal axis which extends longitudinally through the beam.

It has been found that the quality of the entanglement is improved if the yarn advances somewhat diagonally through the entangling yarn duct, as viewed in a longitudinal section of the duct. The present invention renders it possible to adjust each beam so that this condition may be met. In addition, each beam may be preceded and/or followed by a yarn guide bar which extends along the beam and defines the yarn path within the duct. These yarn guide bars may advantageously be connected to the beam and adapted to pivot with the beam.

A preferred embodiment of the invention provides that the supporting frame in which the individual air jet beams are pivotally arranged, is itself adapted to pivot about a horizontal axis. This arrangement permits a further adjustment of the yarn paths through the respective yarn entanglement ducts through the beam. Further, the present apparatus may also effect a relatively slight deflection of the yarn during its passage through the entanglement duct, so that the differences in the traveling length of the yarns preceding and following the apparatus are relatively slight between nip points. Also, the pivotal mounting of the supporting frame also facilitates the initial insertion of the individual yarns.

As a further aspect of the present invention, at least one of the vertical side portions of the supporting frame is preferably constructed as a hollow section which is connected to the pressurized air system. Also, the individual beams include hollow end pivot shafts for mounting to the supporting frame, so that the interior of the beams communicates with the hollow section of the frame and thus the pressurized air system. This arrangement provides a rugged and constructionally simple design, and also, external air connections on the beams are avoided which are a hindrance when a plurality of yarns are to be threaded and guided therethrough. The pressurized air system is preferably supplied to a lower hollow section of the supporting frame, which communicates with the hollow side section.

In one preferred embodiment, the air jet beam is composed of a beam section which has a hollow interior and which defines the longitudinal air passageway. Also, the beam section has a flat exterior upwardly facing surface which extends parallel to its longitudinal direction. The beam is further composed of an elongate cover plate which has a mating flat surface. These two flat surfaces are carefully machined so as to be congruent, and so that the cover plate may be releasably mounted to the beam section with the respective flat surfaces overlying each other. A plurality of parallel channels are formed in at least one of the flat surfaces, with the channels extending transversely to the longitudinal direction of the beam and being longitudinally spaced apart, and such that each channel defines one of the enclosed yarn ducts. As a result, when the cover plate is removed, the yarns may be easily inserted into the respective ducts. Also, each duct is connected via an air jet aperture to the interior of the hollow beam section, which is supplied with pressurized air in the manner described above.

The yarn guide ducts of the beam may be rectangular, with the channels being milled into the flat surface of the beam section. This construction has the advantage that the cover plate requires no machining other than the planing of its flat surface. However, channels may also be formed into both of the flat surfaces which mate with each other when the cover plate is positioned upon the beam. In this manner, it is possible to form yarn ducts with a circular cross section, in that the beam section and the cover plate are securely fastened to each other, and such that the yarn ducts are formed at the interface of the flat surfaces. It is also possible to form the channels only in the cover plate, and in this case, the beam has only a flat surface with the air jet apertures terminating in this surface at a spacing which matches that of the channels formed in the cover plate.

The above-described air jet beam renders it possible to arrange the air ducts very closely to each other, for example at a distance of only 5 mm, and so that the apparatus will be able to air entangle a large number of yarns while remaining relatively small in size.

In an advantageous specific embodiment, the air jet apertures may be arranged with respect to the yarn ducts such that the airstream entering the ducts possesses a component which moves in the direction of the advancement of the yarns. Thus, when the air entangling apparatus of the present invention is arranged behind the draw system, an advantage is obtained in that the entangling nozzles exert a traction on the yarn. In the event a yarn breaks in the winding area, the yarn will tend to be advanced through the entangling apparatus, thereby avoiding the need to rethread the broken end through the duct.

Some of the objects and advantages of the invention having been stated, other objects and advantages will appear as the description proceeds, when considered in conjunction with the accompanying schematic drawings, in which FIGS. 1A and 1B illustrate an apparatus for drawing and heat treating a warp sheet of yarns, and which includes an air entangling apparatus in accordance with a preferred embodiment of the present invention;

Figure 1A:
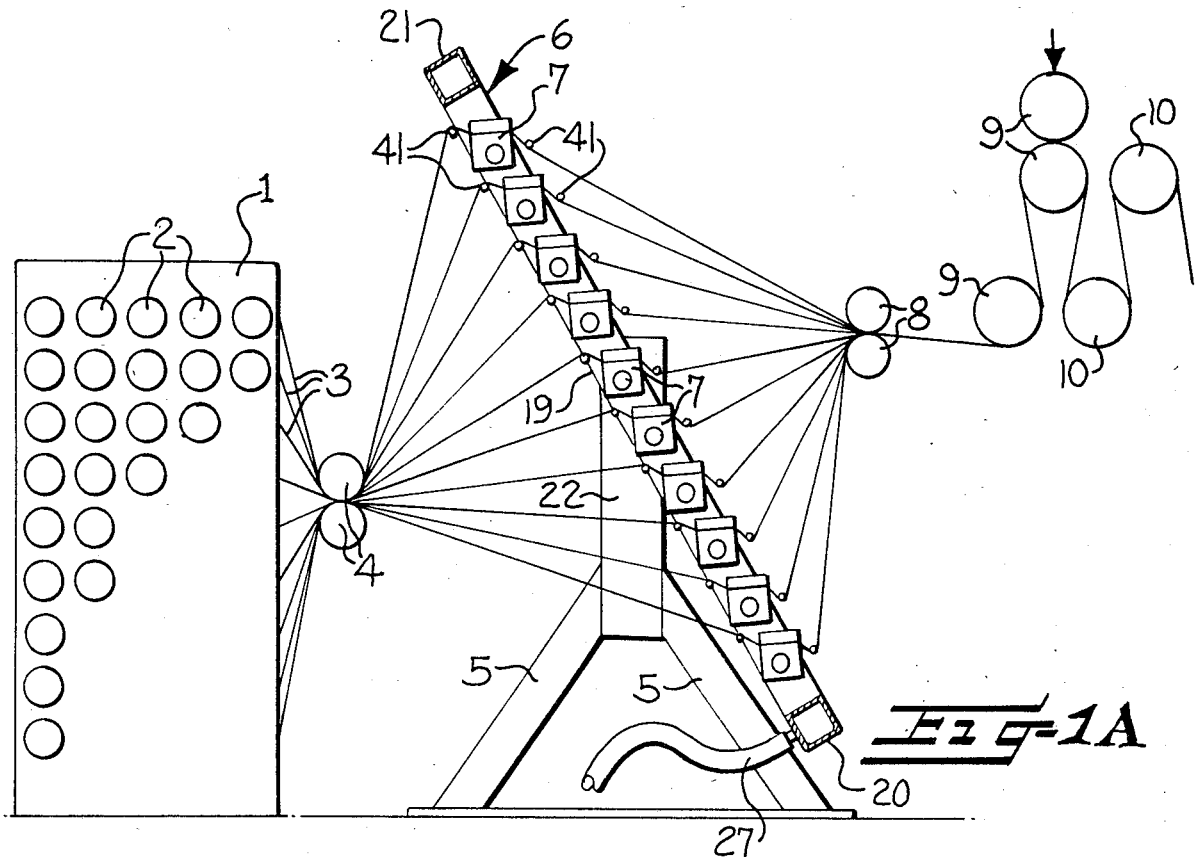
Figure 1B:
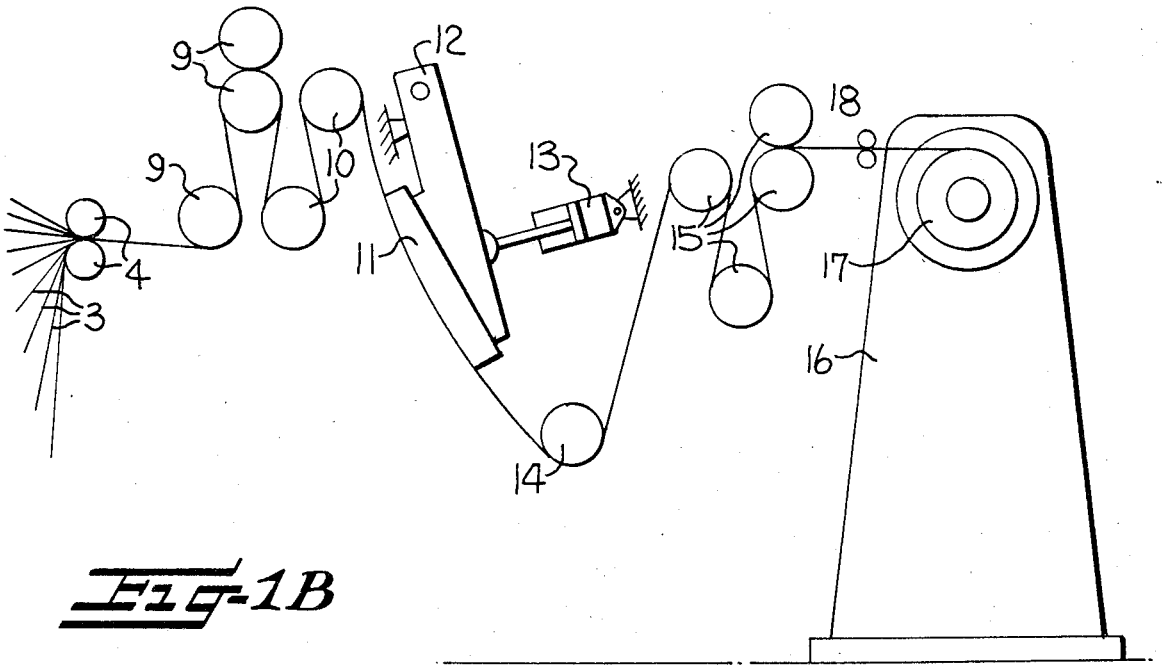

Referring more particularly to the drawings, FIGS. 1A and 1B schematically illustrate a preferred embodiment of an air jet entangling apparatus 6 in accordance with the present invention. As illustrated, the apparatus 6 is shown in association with an apparatus for processing a warp sheet of yarns, and which includes a creel 1 adapted to accommodate a plurality of supply yarn packages 2, such as one thousand or more such packages. The yarns 3 are withdrawn from the packages and advanced via suitable yarn guides, yarn tensioners and yarn detectors (not shown). The yarns are withdrawn by a first pair of rolls 4 and then fanned into groups of yarns and guided through the apparatus 6 of the present invention which is adapted to simultaneously air jet entangle each of the yarns.

Figure 2:
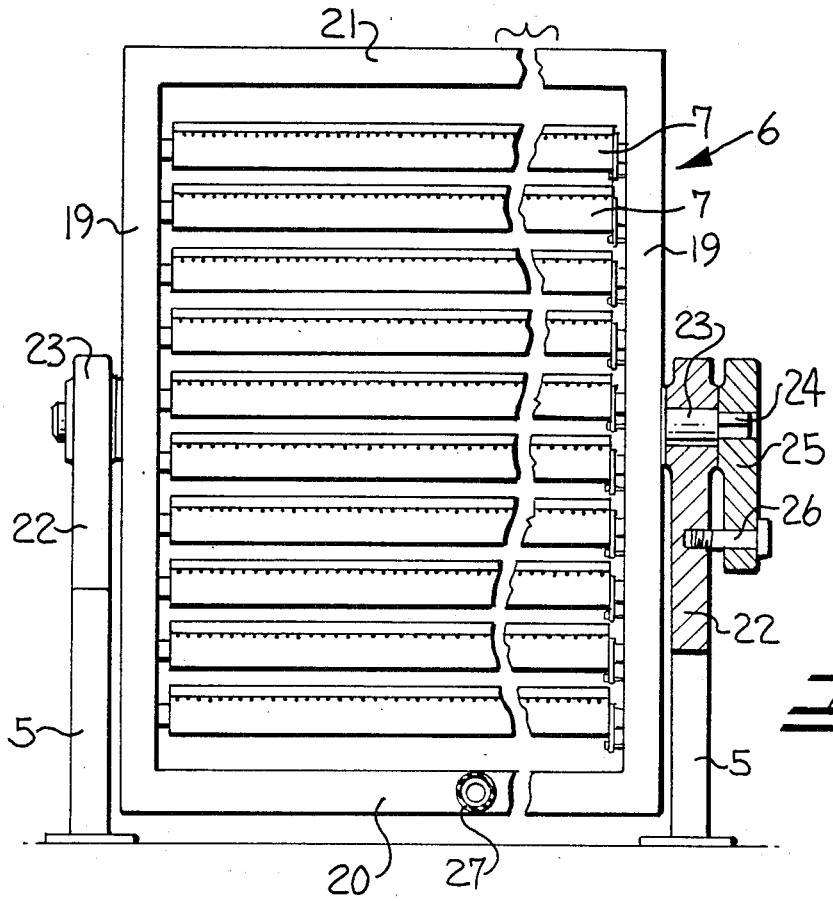
FIG. 2 is a front elevation view of the air entangling apparatus illustrated in FIG. 1A.

The apparatus 6 includes a plurality of air jet beams 7 which are mounted to a supporting structure which is composed of a stand 5 and a rectangular frame as best seen in FIG. 2. The rectangular frame comprises two hollow side members 19, a lower member 20, and an upper member 21. All of these members are hollow, and the lower member 20 mounts an air supply connection 27. The beams 7 are horizontally disposed upon the frame, and vertically spaced apart. In these air jet beams, the multifilament yarns are respectively entangled in a so-called "entanglement nozzle," which improves yarn cohesion, i.e., the coherence of the individual filaments of each yarn, and which also improves the running properties and stretchability of the yarn.

Figure 3A:
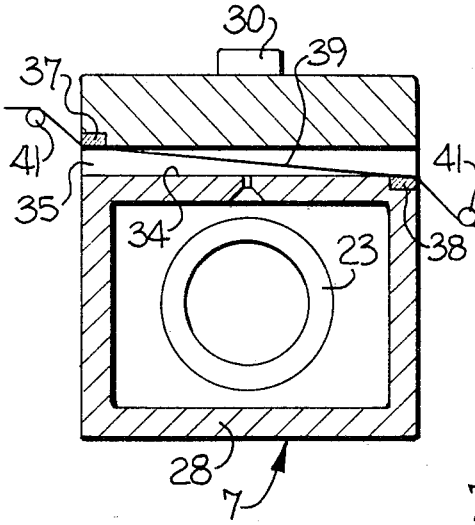
FIG. 3A is a sectional end view of one of the air jet beams of the apparatus shown in FIG. 2.
Figure 3B:
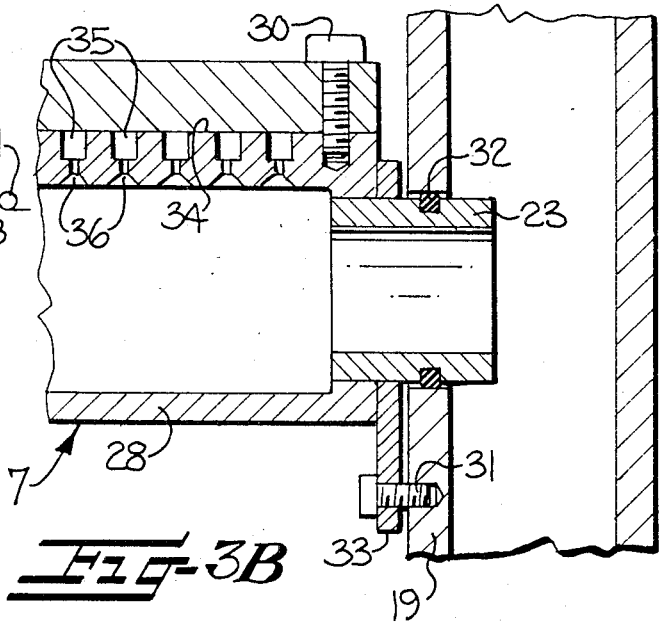
FIG. 3B is a fragmentary horizontal sectional view of the end portion of one of the air jet beams and the supporting frame.
Figure 3C:
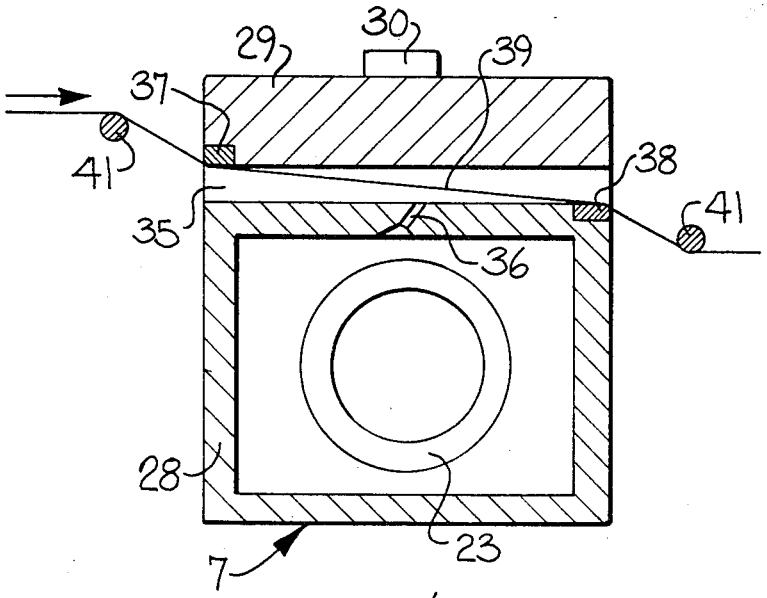
FIG. 3C is a view similar to FIG. 3A, but illustrating an embodiment wherein the air jet apertures are oriented so as to be inclined with respect to the yarn ducts.
Figure 4A:
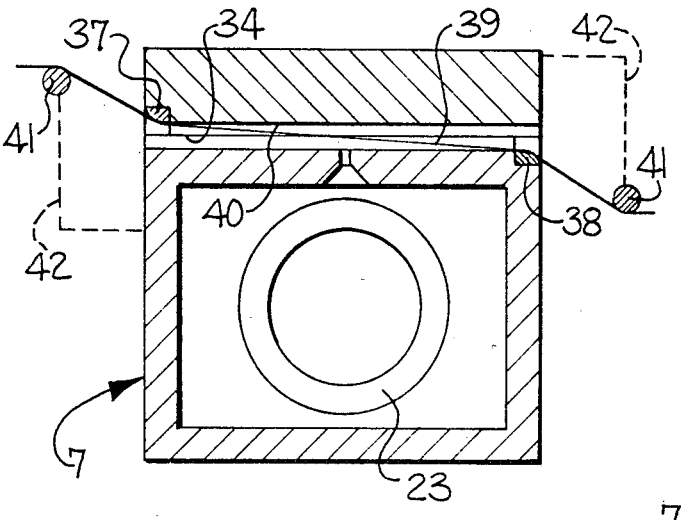
FIG. 4A is a view similar to FIG. 3A, and illustrating a further embodiment of the invention.

The constructional details of the air jet beams and rectangular frame are illustrated in FIGS. 2–4. In the illustrated embodiment, each air jet beam 7 is preceded and followed by a guide rod 41. These guide rods may be connected with the air jet beam in a suitable manner which is illustrated schematically at 42 in FIG. 4A.

After passing through the entangling ducts of the beams 7, the yarns are reunited in a common plane, by passing through the two guide rolls 8. The yarns are then withdrawn by the feed rolls 9 of the draw system. Heated rolls 10 follow, which are heated to about 90° C. in the case of polyester. The yarns then travel over a hot plate 11 where they are heated to more than about 120° C. The hot plate 11 is pivotally mounted on a support bracket 12, and the plate is adapted to be removed from the sheet of yarns by a pneumatic cylinder piston assembly 13. The assembly 13 may be controlled as a function of yarn detectors (not shown). A deflecting roll 14 is mounted downstream of the plate 11, and is followed by delivery rolls 15. The circumferential speed of the delivery rolls 15 is greater than the circumferential speed of the feed rolls 9, or the heated rolls 10, by the draw ratio. The sheet of yarns is then guided via a reed or comb 18 to a warp beam 17 on the beam winder 16.

The constructional details of the air entangling ducts of the present invention are illustrated in FIGS. 2–4. As seen in FIG. 2, the upper portion 22 of the stand 5 pivotally mounts the rectangular frame by means of the shafts 23 which are fixed to the side members 19. The rectangular frame may be pivoted by a square end section 24 which is fixed coaxially to one of the shafts 23, and which mates with a locking mechanism 25. The locking mechanism 25 is adapted to be held in a selected pivoted position by means of a retaining pin 26.

In the embodiment of FIGS. 3A and 3B, each air jet beam 7 is in the form of a rectangular hollow section 28 in cross section and which defines an internal air passageway. A hollow pivotal shaft 23 is mounted at each of the ends of the beam, and by this arrangement, each beam is pivotally mounted in the side walls of the side members 19. A locking mechanism 33 is connected with the beam and permits the beam to be pivoted relative to the frame, and to retain the beam in a desired pivoted position by the retaining pin 30. The shafts 23 are sealed to the side members 19 by the seals 32, so that the interior of the beam 28 is in air communication with the interior of the side members 19, to which the pressurized air is supplied from the lower member 20 and the connection 27.

Each beam section 28 has a flat exterior upwardly facing surface which extends parallel to its longitudinal direction. An elongate cover plate 29 has a mating flat surface, and the cover plate is adapted to be positioned on the flat surface of the beam section 28. The two flat surfaces are accurately machined so that they rest upon each other at the interface 34 without forming a substantial gap. In its operating position, the cover plate 29 is releasably secured to the beam section by retaining bolts 30.

A plurality of parallel channels 35 are formed into the flat surface of the beam section 28, with the channels extending transversely to the longitudinal direction of the beam and being longitudinally spaced apart. An air jet aperture 36 communicates between the channels 35 and the interior of the beam section 28.

With the cover 29 positioned on the beam section 28 in the manner shown in FIGS. 3A and 3B, the channels serve as yarn ducts, in which the advancing yarns are air entangled. It has been found that the yarns are preferably guided diagonally through the entanglement ducts when viewed in a longitudinal section of the channels 35. For this reason, the cover plate 29 has a yarn guide edge 37 at its entry end, and a yarn guide edge 38 is provided on the beam section at the exit edge.

For the purpose of threading the yarns, the cover plate 29 may be removed from the beam section 28. A single yarn may then be readily placed in each channel 35. The guide bars 41 precede the air jet beam, and may be connected with the cover plate 29 and/or the beam section 28, the particular connections not being illustrated in these figures.

As an alternative embodiment, the channels may be formed in the flat surface of the cover plate 29. In this case, the air jet apertures 36 terminate on the flat surface of the beam section 28. Similarly, it is possible to provide less deep channels in the flat surfaces of both the cover plate 29 and the beam section 28.

FIG. 3C illustrates an embodiment wherein the air jet apertures 36' are arranged with respect to the yarn ducts 35 such that the air stream entering the ducts possesses a component which moves in the direction of the advancement of the yarns.

Figure 4B:
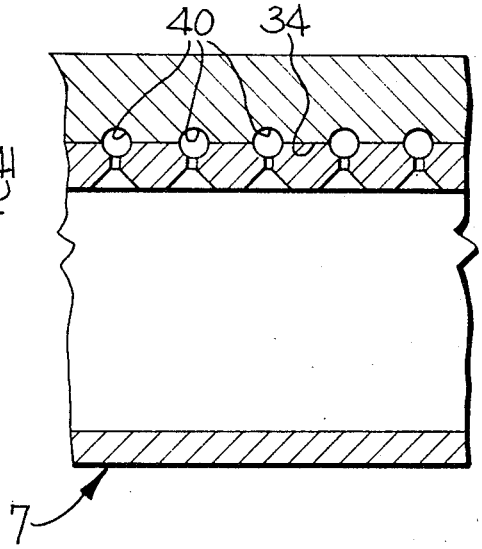
FIG. 4B is a fragmentary longitudinal sectional view of the beam shown in FIG. 4A.

For air entangling certain yarns, it may be preferred to employ yarn ducts of a circular cross section, and a suitable embodiment is shown in FIGS. 4A and 4B. In this embodiment, the cover plate 29 and beam section 28 are tightly secured to each other, with their respective flat surfaces in mating overlying relationship. Further, the ducts 40 are formed at the interface 34, with the ducts 40 extending halfway into the cover plate 29 and halfway into the beam section 28. More particularly, the cover plate and beam section each include semicircular channel portions which mate with each other to form the yarn ducts when the cover plate is assembled to the beam section. Also in the case of this embodiment, the yarn guides 37 and 38 are semicircularly shaped in cross section.

As will be understood, it may occasionally become necessary to put the drawing system illustrated in FIGS. 1A and 1B quickly out of operation. This may be required, for example, when one of the yarns in the sheet breaks. In this event, it is desirable to prevent the other yarns of the sheet from being damaged by the heating means. As shown, this may be done on the one hand by lifting the hot plate 11 from the sheet of yarns. In addition, the present invention provides that the heated rolls 10, may be heated with a fluid and provided with a fluid circulation system which includes valve means through which the heated fluid may be rapidly exchanged for an unheated fluid. These valve means may be operatively connected to a yarn monitoring system of the drawing apparatus. Water is a suitable hot fluid, since temperatures up to 100° C. are desired. Water is also suitable as a cold fluid, with cold being here understood to be a temperature at which the yarns resting on the rolls 10 are no longer damaged.

It should be noted that the surface speed of the rolls 10 may be adjusted independently of those of the rolls 9 or 15, which is known per se from the technology of drawing man-made filament yarns, and in particular polyester yarns.

In the drawings and specification, there has been set forth preferred embodiments of the invention, and although specific terms are employed, they are used in a generic and descriptive sense only, and not for purposes of limitation.

That which we claim is:

1. An apparatus for simultaneously air jet entangling a plurality of advancing multifilament yarns, and which is adapted for use in association with the drawing and warp beaming of such yarns, and comprising a plurality of elongate air jet beams, with each beam having a longitudinal air passageway extending along its length and a plurality of parallel enclosed yarn ducts extending transversely to the longitudinal direction of the beam and being aligned in a longitudinally spaced-apart relation, and an air jet aperture communicating between said air passageway and each yarn duct, means adapted for operatively connecting said air passageway of each beam to pressurized air supply means, and means mounting said air jet beams such that the beams are disposed parallel to each other, and such that the beams are adjustably positioned with respect to each other and to the advancing yarns.

2. The apparatus as defined in claim 1 wherein said mounting means comprises a support frame, with said beams being mounted to said support frame in a horizontally disposed and vertically spaced apart arrangement.

3. The apparatus as defined in claim 2 wherein said mounting means further comprises means pivotally mounting each beam to said support frame for rotational movement about a horizontal axis which extends longitudinally through such beam.

4. The apparatus as defined in claim 3 wherein said mounting means further comprises means pivotally mounting said support frame for pivotal movement about a horizontal axis which is parallel to the pivotal mounting axes of said beams.

5. The apparatus as defined in claim 4 further comprising pressurized air supply means, and wherein said means for operatively connecting said air passageway of each beam to said pressurized air supply means comprises a hollow section in at least one side of said support frame, with the interior of said hollow section communicating with said air passageway of each of said beams and with said air supply means, and such that the pressurized air flows through said hollow section and to said air passageways.

6. The apparatus as defined in claim 5 wherein said means pivotally mounting each beam to said support frame includes a hollow pivot shaft mounted to each beam and such that the hollow section of said supporting frame communicates with the air passageway of the beam via the hollow pivot shaft.

7. An apparatus for air jet entangling a plurality of advancing yarns, and comprising a support frame, an elongate hollow beam section defining a longitudinal direction extending along the length thereof and being pivotally mounted to said support frame for pivotal movement about an axis which extends longitudinally through said beam section, said beam section including a longitudinally extending internal air passageway and further including a flat exterior surface extending parallel to its longitudinal direction, an elongate cover plate having a flat surface extending parallel to its longitudinal direction, means releasably mounting said cover plate to said beam section with the respective flat surfaces overlying each other in a mating relationship, a plurality of parallel channels formed in at least one of said flat surfaces, with said channels extending transversely to the longitudinal direction of the beam section and cover plate, and with the channels being longitudinally spaced apart and such that each channel defines an enclosed yarn duct, and an air jet aperture communicating between said air passageway of said beam and each of said yarn ducts, and whereby the pivotal mounting of the beam section permits the beam section to be adjusted so that the yarn paths through the respective ducts may be adjusted to run through the ducts in a selected direction.

8. The apparatus as defined in claim 7 further comprising means for operatively connecting said air passageway of said beam section to pressurized air supply means.

9. The apparatus as defined in claim 8 further comprising guide means mounted adjacent each of the ends of the yarn ducts for guiding an advancing yarn somewhat diagonally through each duct.

10. The apparatus as defined in claim 8 wherein each of said channels is composed of a channel portion formed in each of said flat surfaces, with the channel portions mating with each other when said cover is assembled to said beam section.

11. The apparatus as defined in claim 8 wherein said air jet apertures are oriented with respect to said yarn ducts such that the airstream entering each duct from the associated air jet aperture has a component in the direction of the yarn advancing through the duct.

* * * * *